United States Patent [19]

Argon

[11] Patent Number: 4,708,051

[45] Date of Patent: Nov. 24, 1987

[54] SHELL LAUNCHING ASSEMBLY

[75] Inventor: Gideon Argon, Tel-Aviv, Israel

[73] Assignee: Salgad International Ltd., Cayman Insel, Jamaica

[21] Appl. No.: 897,516

[22] Filed: Aug. 18, 1986

[30] Foreign Application Priority Data

Feb. 6, 1986 [DE] Fed. Rep. of Germany ..... 3603624

[51] Int. Cl.[4] ..... F41F 19/02

[52] U.S. Cl. ..... 89/40.02; 89/43.01

[58] Field of Search ..... 89/1.3, 1.35, 37.05, 89/40.02, 43.01

[56] References Cited

U.S. PATENT DOCUMENTS 2,790,357 4/1957 Garrett ..... 89/37.05

FOREIGN PATENT DOCUMENTS 66192 12/1982 European Pat. Off. ..... 89/37.05

2131928 6/1984 United Kingdom ..... 89/37.05

*Primary Examiner*—Stephen C. Bentley

*Attorney, Agent, or Firm*—Neil F. Markva

[57] ABSTRACT

A shell launching assembly includes a projector barrel having a smooth, inner wall and an upper end into which a shell is loaded by insertion from above. The assembly comprises an ignition mechanism disposed in a lower end of the barrel closed by a cap member. The projector barrel is positioned in a variable tilted position. A recoil brake mechanism is mounted to cushion the recoil of the projector barrel from a starting position to a recoil position upon firing a shell therefrom. The projector barrel is removably disposed with respect to the recoil brake mechanism so that the barrel may be independently used apart from the launching assembly.

17 Claims, 3 Drawing Figures

FIG. 2
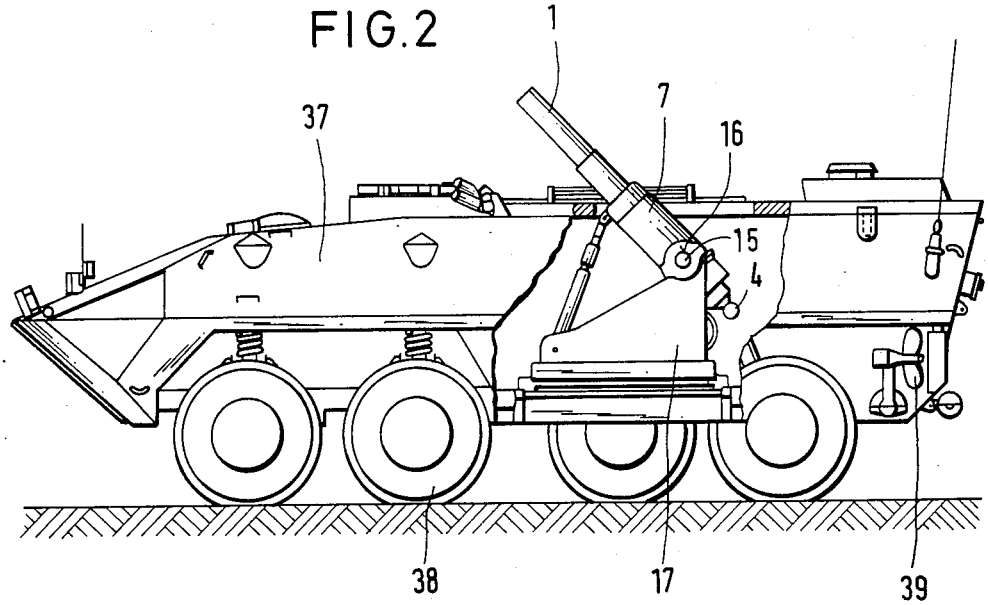
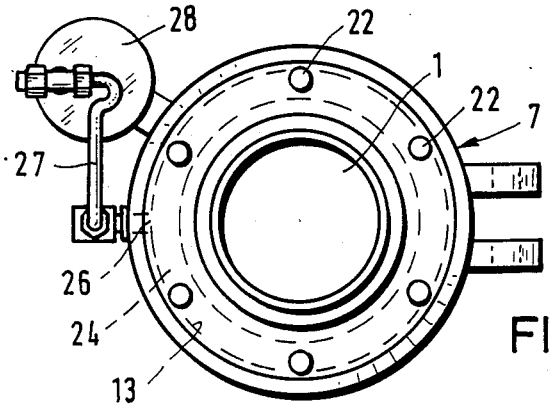
FIG. 3

SHELL LAUNCHING ASSEMBLY

FIELD OF THE INVENTION

This invention relates to a shell launching assembly including a projector barrel having a smooth, inner wall and an upper end into which a shell is loaded by insertion from above. An ignition mechanism is disposed in the lower end of the barrel which is closed by a cap member. More particularly, the invention is directed to a shell launching assembly of the type usually provided with a support such as a bipod for holding the projector barrel in a variable tilted position. When the shell is inserted into the barrel from above, the propellant charge is ignited when the shell contacts the ignition mechanism and is thereby launched.

BACKGROUND OF THE INVENTION

Known projector barrels for shell launchers are closed at the lower end thereof by a closure cap and include a breech ring which is substantially spherical in shape. The breech ring is used to engage a base plate which lies on the ground and is secured against slippage by a structure such as ribs formed thereon. The recoil of such projector barrels can be comparatively well absorbed when shells are fired with the barrel engaged with such a base plate. It has been found that such recoil may be absorbed even with projector barrels having a fairly large caliber as in the case of 120 mm.

Such shell launching assemblies are relatively easy to operate and to transport. With barrels having heavy calibers such as 120 mm., shell launching assemblies using the base plate produce comparatively large recoil forces which are immediately absorbed by the base plate. When mounting shell launching assemblies for smaller caliber barrels on the loading surface of a vehicle, the base plate is connected directly to such loading surface. In this instance, the substructure of the vehicle must be appropriately reinforced because of the absorption of the recoil forces.

However, it has been found impractical to mount shell launching assemblies of larger caliber projector barrels in this way onto a vehicle because of the type of construction necessary and the related expense. For example, the recoil forces of a 120 mm. caliber projector barrel may attain from about 100 to 160 tons. Even with a specific reinforcement of the substructure, conventional vehicles are not able to absorb such forces. Furthermore, the construction of such a vehicle is simply not cost effective.

SUMMARY OF THE INVENTION

The primary object of the invention is to provide a shell launching assembly of the type specified herein wherein it is possible to fire projectiles having a relatively large caliber from vehicles without extensive reinforcement required on the vehicle.

Furthermore, the shell launching assembly of the invention has a projector barrel removably disposed with respect to recoil brake means so that the barrel may be independently used apart from the launching assembly in a conventional manner using a base plate disposed on the ground.

The shell launching assembly includes a projector barrel having a smooth, inner wall and an upper end into which a shell is loaded by insertion from above. The assembly comprises an ignition mechanism disposed in a lower end of the barrel closed by cap means.

Mounting means supports the projector barrel in a variable tilted position. The mounting means includes recoil brake means mounted to cushion the recoil of the projector barrel from a starting position to a recoil position upon firing a shell therefrom.

The recoil brake means includes a fixed, recoil section and coupling means for connecting a movable, recoil section to the fixed, recoil section. The cap means includes a closure cap member fixed to the lower end of the barrel and attaching means cooperating with the closure member to removably secure the projector barrel to the body portion of the movable, recoil section. The closure cap member includes a breech ring and the ignition mechanism with the breech ring projecting outwardly and in a direction away from the barrel. The breech ring can be inserted into a base plate with the recoil brake means being mounted in a cradle when disposed in a vehicle.

Another feature of the invention is directed to the construction of the cap means which includes a closure cap member having flange means extending outwardly therefrom. The flange means may take the form of an integral flange, collar or the like and is used to hold the projector barrel in place within the movable, recoil section. Attaching means includes a clamping collar member or nut which is secured to the body portion of the movable, recoil section and contacts or grips the flange means for securing the projector barrel when the collar member is engaged to the body portion.

This construction of the cap means for the projector barrel permits a very simple assembly and dismantling of the projector barrel from the recoil brake means. The lower end of the projector barrel remains closed at the lower end. The clamping collar member is simply removed and the projector barrel simply slides out of the central bore of the movable, recoil section. Once removed, the projector barrel can be connected to a base plate or the like in a conventional manner using the breech ring described above. This particular feature maintains ease of handling for loading the projector barrel, accuracy and range in firing both in the vehicle-mounted position and the use apart from the shell launching assembly.

A further feature is directed to the structure of the recoil brake means into which the projector barrel is inserted and secured. The recoil brake means includes a movable, recoil section having a first, inner cylindrical jacket and a second cylindrical jacket laterally spaced outwardly from the first, inner jacket to form an annular guide space therebetween. The first, inner cylindrical jacket has a central bore for slidingly receiving the projectile barrel therein. The fixed, recoil section includes a fixed, inner guide sleeve and a fixed, outer jacket laterally spaced outwardly from the fixed, inner guide sleeve to form an annular pressure chamber within which the second cylindrical jacket of the movable, recoil section moves with respect to the fixed, recoil section. The fixed, inner guide sleeve is slidingly disposed within the annular guide space of the movable, recoil section.

An annular piston member is located on the second cylindrical jacket of the movable, recoil section and is disposed to move within the annular pressure chamber. Spring means is disposed within the annular pressure chamber and between first abutment means on the fixed, recoil section and second abutment means located on the annular piston which is a part of the movable recoil section.

The fixed, outer jacket has an outer surface from which transverse pivot pins project. The mounting means of the vehicle-mounted shell launching assembly includes a cradle having bearings which receive the transverse pins. Thus, the launching assembly of the invention is adapted to the conventional mounting construction found in such vehicle-mounted assembies.

A still further feature of the invention is the structure of the recoil brake means wherein the annular pressure chamber is filled with oil to surround the spring means which may be a coil spring mounted between the first and second abutment means. Choke bore means cooperating with the annular piston member allows oil to slowly pass by the piston member as it moves between the starting position and a recoil position within the annular pressure chamber. Thus, any recoil effect is cushioned by pressure build-up within the oil surrounding the spring. The annular pressure chamber includes a lower chamber portion containing the spring and an upper chamber portion into which the oil passes as the piston member moves from the starting position to a recoil position within the annular pressure chamber upon firing a projectile from the projector barrel.

A further feature is directed to the use of an oil supply means connected to the annular pressure chamber to maintain oil within the pressure chamber. The oil supply means includes an oil supply container mounted on an outer surface of the fixed, outer jacket and conduit means to direct oil from the supply container to the annular pressure chamber.

In a specific embodiment of the shell launching assembly of the invention, outer guide means includes a stationary outer guide portion mounted to the fixed, recoil section and a movable, outer guide portion mounted to the movable, recoil section. The stationary and movable guide portions cooperate with each other to prevent rotation of the barrel with respect to the fixed, recoil section of the mounting means. One of the outer guide portions is a guide rod and the other of the outer guide portions includes bore means for slidingly receiving the guide rod.

ADVANTAGES OF THE INVENTION

The shell launching assembly of this invention unites several essential features. The use of a smooth bore with the loading by insertion from above of a fin-stabilized projectile has a universal application. The launching assembly may be used with fairly large caliber projectiles which can be fired on lighter vehicles without additional and costly reinforcement of the vehicle substructure. The advantages of the weapon with respect to simplicity of construction, accuracy of firing and preservation of the range of the weapon remain the same as when the projector barrel is fired from a position supported on the floor, ground or the like.

The shell launching assembly of the invention is designed to be substantially more mobile with respect to the possibilities for its use without great expenditure being necessary. At the same time, the projector barrel may be easily dismantled from the recoil brake mechanism and used in its conventional manner with respect to a base plate placed on a floor or ground location. Neither the projector barrel nor the firing mechanism requires any change to effect the independent use of the projector barrel apart from the shell launching assembly of the invention.

BRIEF DESCRIPTION OF DRAWINGS

Other objects of this invention will appear in the following description and claims, reference being made to the accompanying drawings forming a part of the specification wherein like reference characters designate corresponding parts in the several views.

FIG. 2 is an elevational view, partly in section, showing a vehicle-mounted shell launching assembly according to the invention; and FIG. 3 is a fragmentary elevational view showing an oil supply means for the shell launching assembly of the invention.

DETAILED DESCRIPTION

Figure 1:
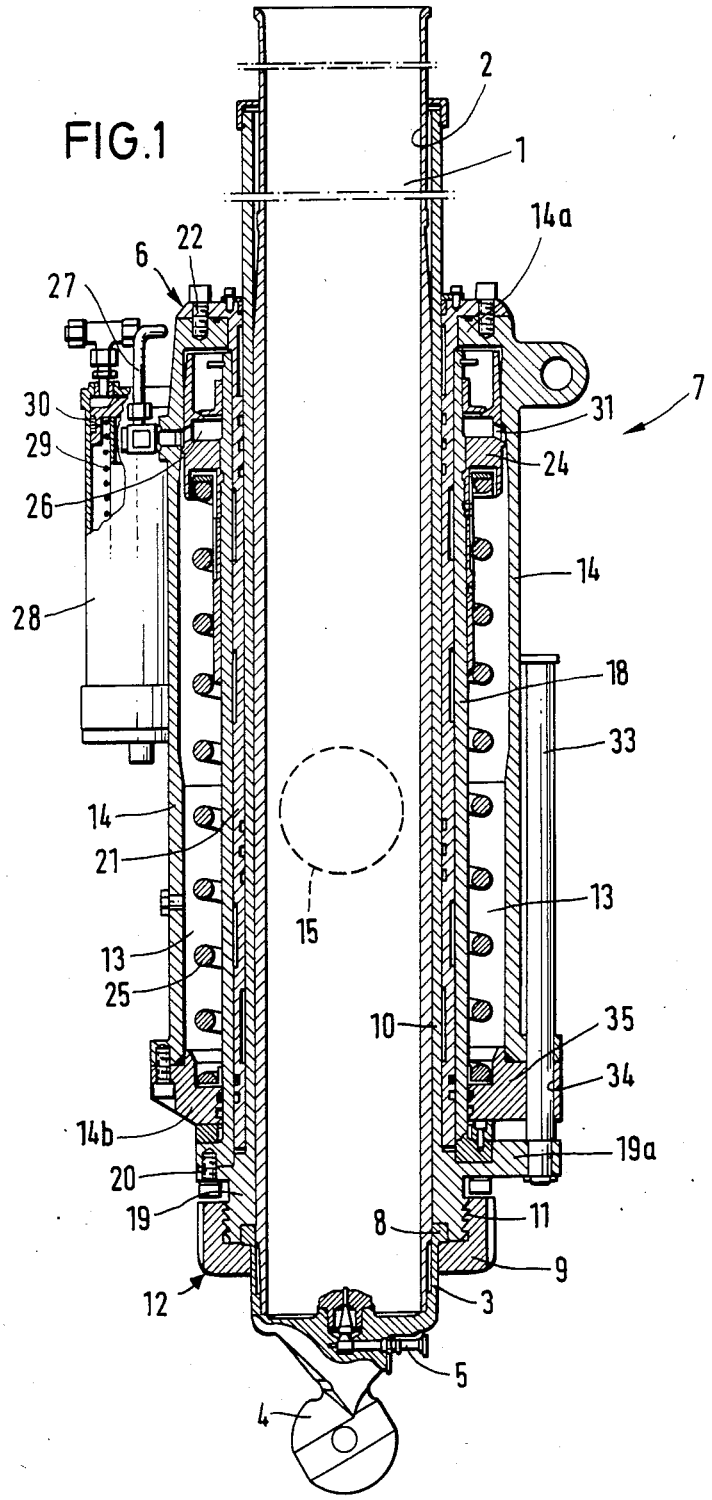
FIG. 1 is a longitudinal cross-sectional schematic view of the combination of a projector barrel and a recoil brake mechanism in a shell launching assembly according to the invention.

The projector barrel 1 of a shell launching assembly of the invention has a smooth inner wall 2. Thus, a fin-stabilized shell can be loaded from above into the projector barrel. A closure cap 3 threadingly engages and closes the lower end of the barrel 1. One side of the cap 3 is fixedly secured to the lower end of barrel 1 and a breech ring 4 is fixedly secured to the other side of the cap member 3. Breech ring 4 has a structural configuration that is conventional and approximately spherical in design which can be inserted into a base plate placed on the ground or the floor. Thus, projector barrel 1 may be connected to a base plate with a universal joint type connection which is well known in the prior art.

Cap 3 includes the breech ring 4 and ignition system 5 which causes the ignition of the propellant charge of a fin stabilized shell which hits the base of closure cap 3 thereby driving the shell out of the projector barrel 1. Projector barrel 1 is thus normally held in the desired tilted position by a conventional holding device such as a bipod or the like.

The combination incorporating the projector barrel 1 with its closure cap 3, breech ring 4 and ignition mechanism 5 may be easily assembled and dismantled as a part of the recoil brake assembly, generally designated 7 and concentrically mounted with respect to projector barrel 1, shown. Closure cap 3 includes a flange 8. Attaching means includes a clamping collar member 9 which threadingly engages threads 11 on the movable, recoil section, generally designated 12, of recoil assembly 7. Thus, projector barrel 1 is braced firmly within the movable, recoil section of recoil brake assembly 7 so that it is braced to extend in the axial direction of barrel 1.

Barrel 1 slidingly engages a central bore of the movable, recoil section 12 and located in a first, cylindrical jacket 10. By releasing the clamping collar member 9, projector barrel 1 can be easily removed from the cylindrical jacket 10 as a whole, functioning unit. Thus, projector barrel 1 remains capable of receiving and firing a fin-stabilized shell without any changes having to be made when it is inserted into a base plate and the ammunition is fired with the barrel 1 being independently used apart from the launching assembly of the invention.

The recoil brake assembly 7 includes a fixed, recoil section, generally designated 6, and a movable, recoil section 12. The fixed, recoil section 6 has an outer surface from which transverse pivot pins 15 project. Pins 15 are received by bearings 16 of the cradle 17 forming a portion of the mounting means in vehicle 37 as shown in FIG. 2. Vehicle 37 includes drive means such as wheels 38 for movement on land and propellor 39 for movement in water. Cradle 17 is the fixed part on which the shift movement resulting from recoil upon firing is absorbed under a cushioning effect via the recoil brake assembly 7.

Movable, recoil section 12 includes a first, inner cylindrical jacket 10 and a second cylindrical jacket 18 laterally spaced outwardly from the first, inner jacket 10 to form an annular guide space therebetween. Screws 20 fixedly connect lower ring 19 of recoil section 12 to the second cylindrical jacket 18 as shown. The first, inner cylindrical jacket 10 has a central bore which slidingly receives projector barrel 1 therein.

The fixed, recoil section 6 includes a fixed, inner guide sleeve 21 and a fixed, outer jacket 14 laterally spaced outwardly from the fixed, inner guide sleeve 21 to form an annular pressure chamber 13 therebetween. Screws 22 fixedly connect the upper end of guide sleeve 21 to the head part 14*a* of outer jacket 14. Lower collar 14*b* is connected to the bottom of outer jacket 14 via screws as shown.

An annular piston member 24 is disposed on the second cylindrical jacket 18 for movement within annular pressure chamber 13. Spring 25 is disposed within annular pressure chamber 13 between first abutment means on collar 14*b* of the fixed, recoil section 6 and second abutment means on the annular piston 24 of the movable, recoil section 12. The annular pressure chamber 13 is filled with oil. Thus, the spring 25 is surrounded by the oil.

An upper chamber portion 26 located above piston member 24 is connected to a supply container 28 via line 27. Supply container 28 includes a piston which is under the affect of a spring 29 so that leakage oil and the like can be replaced from container 28. A choke bore 31 connects a lower chamber portion containing the spring 25 and the upper chamber portion 26. Choke bore 31 allows oil to slowly pass by piston member 24 as it moves between the starting position a shown in FIG. 1 and a recoil position within the annular pressure chamber when the weapon is fired. Thus, any recoil effect is cushioned by pressure build-up within the oil surrounding the spring 25 in annular chamber 13. The oil passes into the upper annular chamber portion 26 as piston member 24 moves downwardly upon firing.

Securing means are provided to prevent rotation of the movable, recoil section 12 with respect to the fixed, recoil section 6. This would happen as the respective sections 6 and 12 move in the longitudinal axis with respect to each other. The lower ring 19 includes a radial projection 19*a* on which a guide rod 33 is fixedly disposed. The lower collar 14*b* on fixed section 6 includes an extension 35 including a bore 34 which slidingly receives guide rod 33. Thus, outer guide means includes the stationary outer guide portion 35 and a movable outer guide portion 19 and 33. The stationary and movable guide portions cooperate with each other to prevent rotation of the barrel with respect to the fixed, recoil section 6 of the mounting means.

In operation, when a shell is fired from projector barrel 1, movable, recoil section 12 is moved downwardly by the recoil produced in projection barrel 1. As movable section 12 moves downwardly, spring 25 is compressed within the annular pressure chamber 13 and there is a pressure build-up in the oil located therein. The oil can flow only through choke bore 31 from the lower annular chamber 13 to the upper annular chamber portion 26. Thus, there is a significant cushioning effect achieved by the recoil brake assembly 7. Once the recoil effect is complete, compressed spring 25 presses the inner, double-walled recoil section 12 together with projector barrel 1 back into the starting position as shown in FIG. 1.

While the shell launching assembly has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A shell launching assembly including a projector barrel having a smooth, inner wall and an upper end into which a shell is loaded by insertion from above, said assembly comprising:

(a) an ignition mechanism disposed in a lower end of the barrel closed by cap means, and (b) mounting means for supporting the projector barrel in a variable tilted position, (c) said mounting means including recoil brake means concentrically mounted with respect to the projector barrel to cushion the recoil of the projector barrel from a starting position to a recoil position upon firing a shell therefrom, (d) said projector barrel being removably disposed with respect to the recoil brake means so that the barrel may be independently used apart from the launching assembly, (e) the cap means including a closure cap member fixed to the lower end of the barrel and attaching means cooperating with the closure cap member to removably secure the projector barrel to the recoil brake means, (f) the closure cap member having flange means extending outwardly therefrom, (g) the attaching means including a clamping collar member to engage the recoil brake means and to contact said flange means for securing the projector barrel when the collar member is engaged to said recoil brake means, (h) said mounting means including cradle means having bearings which receive transverse pivot pins located on the recoil brake means, and (i) said cradle means being fixedly located in a vehicle.

2. A shell launching assembly as defined in claim 1 wherein the recoil brake means includes a fixed, recoil section and coupling means for connecting a movable, recoil section to the fixed, recoil section.

3. A shell launching assembly as defined in claim 2 wherein the movable, recoil section includes the cap means and a body portion with a central bore which receives the projector barrel, and the body portion slidingly engages the fixed, recoil section.

4. A shell launching assembly as defined in claim 2 wherein the fixed, recoil section has an outer surface from which transverse pivot pins project.

5. A shell launching assembly as defined in claim 4 wherein the vehicle includes drive means for movement on land and in water.

6. A shell launching assembly as defined in claim 2 wherein outer guide means includes a stationary outer guide portion mounted to the fixed, recoil section and a movable outer guide portion mounted to the movable, recoil section, said stationary and movable guide portions cooperating with each other to prevent rotation of the barrel with respect to the fixed, recoil section of the mounting means.

7. A shell launching assembly as defined in claim 6 wherein one of the outer guide portions is a guide rod and the other of the outer guide portions includes bore means for slidingly receiving the guide rod.

8. A shell launching assembly as defined in claim 1 wherein the closure cap member includes a breech ring and the ignition mechanism, said breech ring projecting outwardly and in a direction away from the barrel.

9. A shell launching assembly as defined in claim 1 wherein the closure cap member has one side fixedly secured to the lower end of the barrel and a breech ring fixedly secured to the other side of the cap member, the breech ring having a structural configuration effective to be inserted into a base plate for said independent use apart from the launching assembly.

10. A shell launching assembly including a projector barrel having a smooth, inner wall and an upper end into which a shell is loaded by insertion from above, said assembly comprising:

(a) an ignition mechanism disposed in a lower end of the barrel closed by cap means, and (b) mounting means for supporting the projector barrel in a variable tilted position, (c) said mounting means including recoil brake means mounted to cushion to recoil of the projector barrel from a starting position to a recoil position upon firing a shell therefrom, (d) said projector barrel being removably disposed with respect to the recoil brake means so that the barrel may be independently used apart from the launching assembly, (e) the recoil brake means including a fixed, recoil section and coupling means for connecting a movable, recoil section to the fixed, recoil section, (f) the movable, recoil section including a first, inner cylindrical jacket and a second cylindrical jacket laterally spaced outwardly from the first, inner jacket to form an annular guide spaced therebetween, (g) said first, inner cylindrical jacket having a central bore for slidingly receiving the projector barrel therein.

11. A shell launching assembly as defined in claim 10 wherein the fixed, recoil section includes a fixed, inner guide sleeve and a fixed, outer jacket laterally spaced outwardly from the fixed, inner guide sleeve to form an annular pressure chamber within which the second cylindrical jacket of the movable, recoil section moves with rspect to the fixed, recoil section, the fixed, inner guide sleeve being slidingly disposed within said annular guide space of the movable, recoil section.

12. A shell launching assembly as defined in claim 11 wherein spring means is disposed within the annular pressure chamber and between first abutment means on said fixed, recoil section and second abutment means on said movable, recoil section, said spring means being subjected to compression upon firing a shell from said projector barrel to cushion the recoil effect upon said firing and to return said movable, recoil section from a recoil position to said starting position.

13. A shell launching assembly as defined in claim 12 wherein an annular piston member is located on said second cylindrical jacket of the movable, recoil section and is disposed to move within said annular pressure chamber, said second abutment means being located on said annular piston.

14. A shell launching assembly as defined in claim 13 wherein said annular pressure chamber is filled with oil to surround said spring means, choke bore means allows oil to slowly pass by the piston member as the piston member moves between the starting position and a recoil position within the annular pressure chamber, whereby said recoil effect is cushioned by pressure build-up within the oil surrounding the spring means.

15. A shell launching assembly as defined in claim 14 wherein said annular pressure chamber includes a lower chamber portion containing said spring means and an upper chamber portion into which the oil passes as the piston member moves from said starting position to a recoil position within said annular pressure chamber.

16. A shell launching assembly as defined in claim 14 wherein oil supply means is connected to the annular pressure chamber to maintain oil within said pressure chamber.

17. A shell launching assembly as defined in claim 16 wherein said oil supply means includes an oil supply container mounted on an outer surface of the fixed, outer jacket and conduit means to direct oil from the supply container to the annular pressure chamber.

* * * * *